US011114808B2

(12) United States Patent
Huang et al.

(10) Patent No.: US 11,114,808 B2
(45) Date of Patent: Sep. 7, 2021

(54) CONNECTOR ASSEMBLY

(71) Applicant: Tarng Yu Enterprise co., ltd., New Taipei (TW)

(72) Inventors: Mu-Jung Huang, New Taipei (TW); Ying-Chung Chen, New Taipei (TW)

(73) Assignee: TARNG YU ENTERPRISE CO., LTD., New Taipei (TW)

( * ) Notice: Subject to any disclaimer, the term of this patent is extended or adjusted under 35 U.S.C. 154(b) by 0 days.

(21) Appl. No.: 16/918,912

(22) Filed: Jul. 1, 2020

(65) Prior Publication Data

US 2021/0006023 A1 Jan. 7, 2021

(30) Foreign Application Priority Data

Jul. 1, 2019 (TW) ..... 108123155

(51) Int. Cl.
*H01R 39/64* (2006.01)
*H01R 24/38* (2011.01)
*H01R 35/04* (2006.01)

(52) U.S. Cl.
CPC ..... *H01R 39/64* (2013.01); *H01R 24/38* (2013.01); *H01R 35/04* (2013.01)

(58) Field of Classification Search
CPC .... H01R 39/64; H01R 13/2457; H01R 35/04; H01R 13/04; H01R 13/10; H01R 24/38; H01R 13/40; H01R 13/502; H01R 12/714; H01R 13/22; H01R 13/24; H01R 13/2407; H01R 13/2492
See application file for complete search history.

(56) References Cited

U.S. PATENT DOCUMENTS

| | | | | |
|---|---|---|---|---|
| 3,521,216 | A * | 7/1970 | Tolegian | H01R 13/6205 439/39 |
| 3,808,577 | A * | 4/1974 | Mathauser | H01R 13/6205 439/39 |
| 9,281,638 | B2 * | 3/2016 | McBroom | H01R 24/38 |
| 9,660,378 | B2 * | 5/2017 | Silvers | H01R 31/06 |
| 10,008,815 | B2 * | 6/2018 | Flechl | H01R 13/639 |
| 10,923,852 | B2 * | 2/2021 | Huang | H04M 1/0249 |
| 2015/0333458 | A1 * | 11/2015 | Hallsten | H01R 24/58 439/39 |
| 2018/0062330 | A1 * | 3/2018 | Roberts | H01R 24/38 |

* cited by examiner

*Primary Examiner* — Travis S Chambers
(74) *Attorney, Agent, or Firm* — Chun-Ming Shih; Lanway IPR Services

(57) ABSTRACT

A connector assembly including a female connector and a male connector. The female connector and the male connector both can rotate relatively. The female connector includes a plurality of female conductors, and the male connector includes a plurality of male conductors. When the female connector and the male connector both rotate relatively, each of the female conductors can be electrically connected to at least one of the plurality of male conductors, thereby assuring electrical connection between the female connector and the male connector. This configuration, when being applied to a wearable device, allows function elements of the wearable device to be expanded and modified.

12 Claims, 15 Drawing Sheets

12

CONNECTOR ASSEMBLY

CROSS-REFERENCE TO RELATED APPLICATIONS

This application claims the priority of Republic of China Patent Application No. 108123155 filed on Jul. 1, 2019, in the State Intellectual Property Office of the R.O.C., the disclosure of which is incorporated herein by reference.

BACKGROUND OF THE INVENTION

Field of the Invention

The present invention relates to connector component, and more particularly, to a connector assembly that includes the female connector and the male connector both can rotate relatively.

Descriptions of the Related Art

Human life becomes more convenient with innovation of wearable devices such as smart clothing, wearable medical device, motion or biological detection device, consumer device, and so on. The wearable devices have been developed in a way that their function elements are gradually reduced in size and even can be expanded and modified in response to user's requirements.

Therefore, how to provide a connector assembly, which allows expansion and modification of function elements for a wearable device, is a challenging task to be achieved in the art.

SUMMARY OF THE INVENTION

In view of the above drawbacks in the prior art, a primary object of the present invention is to provide a connector assembly including: a female connector including: a female insulator defined with a first female circular trajectory, and including a first female circular insertion slot and a plurality of first female conductor mounting areas, wherein the first female circular insertion slot is extended along the first female circular trajectory, and the plurality of first female conductor mounting areas are placed at intervals along the first female circular trajectory in a manner that, on the first female circular trajectory there is an interval of first arc angle between adjacent two of the first female conductor mounting areas; a plurality of first female conductors, each of which is mounted on a corresponding one of the plurality of first female conductor mounting areas, wherein the plurality of first female conductors are provided on the first female circular trajectory with the interval of first arc angle between adjacent two of the first female conductors; and a male connector including: a male insulator defined with a first male circular trajectory and including a plurality of first male conductor mounting areas, wherein the plurality of first male conductor mounting areas are placed at intervals along the first male circular trajectory in a manner that, on the first male circular trajectory there is an interval of second arc angle between adjacent two of the first male conductor mounting areas; a plurality of first male conductors, each of which is mounted on a corresponding one of the plurality of first male conductor mounting areas, wherein the plurality of first male conductors are provided on the first male circular trajectory with the interval of second arc angle between adjacent two of the first male conductors; wherein, the first female circular trajectory and the first male circular trajectory have substantially identical contour, allowing each of the first male conductors to be able to enter the first female circular insertion slot; the first arc angle is substantially different in value from the second arc angle, allowing at least one of the plurality of first female conductors to be electrically connected to at least one of the plurality of first male conductors entering the first female circular insertion slot so as to assure electrical connection between the female connector and the male connector.

Preferably, in the connector assembly said above, wherein the plurality of first female conductors are substantially different in number from the plurality of first male conductors.

Preferably, in the connector assembly said above, wherein the female insulator further includes: an outer female circular wall and a middle female circular wall, wherein the middle female circular wall is surrounded by the outer female circular wall, wherein the first female circular insertion slot and the plurality of first female conductor mounting areas are located between the outer female circular wall and the middle female circular wall.

Preferably, in the connector assembly said above, wherein the female insulator further includes a plurality of first conductor embedding slots, each of which resides in a corresponding one of the plurality of first female conductor mounting areas and is extended to the outer female circular wall or the middle female circular wall, allowing the outer female circular wall or the middle female circular wall to fix the plurality of first female conductors in position.

Preferably, in the connector assembly said above, wherein the female connector further includes a plurality of second female conductors; the female insulator is further defined with a second female circular trajectory, and includes a second female circular insertion slot and a plurality of second female conductor mounting areas, wherein the second female circular insertion slot is extended along the second female circular trajectory, and the plurality of second female conductor mounting areas are placed along the second female circular trajectory in a manner that, on the second female circular trajectory the interval of first arc angle is provided between adjacent two of the second female conductor mounting areas; each of the plurality of second female conductors is mounted on a corresponding one of the plurality of second female conductor mounting areas, wherein the plurality of second female conductors are provided on the second female circular trajectory with the interval of first arc angle between adjacent two of the second female conductors; the male connector further includes a plurality of second male conductors; the male insulator is further defined with a second male circular trajectory and includes a plurality of second male conductor mounting areas, wherein the plurality of second male conductor mounting areas are placed along the second male circular trajectory in a manner that, on the second male circular trajectory the interval of second arc angle is provided between adjacent two of the second male conductor mounting areas; each of the plurality of second male conductors is mounted on a corresponding one of the plurality of second male conductor mounting areas, wherein the plurality of second male conductors are provided on the second male circular trajectory with the interval of second arc angle between adjacent two of the second male conductors; wherein, the second female circular trajectory and the second male circular trajectory have substantially identical contour, allowing each of the second male conductors to be able to enter the second female circular insertion slot; the first arc angle is substantially different in value from the second arc angle, allowing at least one of the plurality of second female conductors to be electrically connected to at least one of the plurality of second male conductors entering the second female circular insertion slot so as to achieve the electrical connection between the female connector and the male connector.

Preferably, in the connector assembly said above, wherein the plurality of second female conductors are substantially different in number from the plurality of second male conductors.

Preferably, in the connector assembly said above, wherein each of the plurality of first female conductors includes a first clamping structure, and each of the plurality of first male conductors includes a first flake-shaped structure, allowing at least one of the plurality of first female conductors to grip and hold in position at least one of the plurality of first male conductors entering the first female circular insertion slot; each of the plurality of second female conductors includes a second clamping structure, and each of the plurality of second male conductors includes a second flake-shaped structure, allowing at least one of the plurality of second female conductors to grip and hold in position at least one of the plurality of second male conductors entering the second female circular insertion slot.

Preferably, in the connector assembly said above, wherein the second female circular trajectory is surrounded by the first female circular trajectory.

Preferably, in the connector assembly said above, wherein the female insulator further includes: an outer female circular wall, a middle female circular wall and an inner female circular wall, wherein the middle female circular wall is surrounded by the outer female circular wall, and the inner female circular wall is surrounded by the middle female circular wall, wherein the first female circular insertion slot and the plurality of first female conductor mounting areas are located between the outer female circular wall and the middle female circular wall, and the second female circular insertion slot and the plurality of second female conductor mounting areas are located between the middle female circular wall and the inner female circular wall.

Preferably, in the connector assembly said above, wherein the female insulator further includes a plurality of first conductor embedding slots, each of which resides in a corresponding one of the plurality of first female conductor mounting areas and is extended to the outer female circular wall or the middle female circular wall, allowing the outer female circular wall or the middle female circular wall to fix the plurality of first female conductors in position; the female insulator further includes a plurality of second conductor embedding slots, each of which resides in a corresponding one of the plurality of second female conductor mounting areas and is extended to the middle female circular wall or the inner female circular wall, allowing the middle female circular wall or the inner female circular wall to fix the plurality of second female conductors in position.

Preferably, in the connector assembly said above, wherein the male connector further includes a male fastening structure for coupling the male insulator and provided along the first male circular trajectory, and the female connector further includes a female fastening structure for coupling the female insulator and provided along the first female circular trajectory, wherein when the first male conductors are entering the first female circular insertion slot, the male fastening structure is fastened to the female fastening structure.

Preferably, in the connector assembly said above, wherein the first arc angle is substantially an angle of 120 degrees, and the second arc angle is substantially an angle of 90 degrees.

In summary, a primary object of the present invention is to provide a connector assembly including a female connector and a male connector. The female connector and the male connector both can rotate relatively. The female connector includes a plurality of female conductors, and the male connector includes a plurality of male conductors. When the female connector and the male connector both rotate relatively, each of the female conductors can be electrically connected to at least one of the plurality of male conductors, thereby assuring electrical connection between the female connector and the male connector. This configuration, when being applied to a wearable device, allows function elements of the wearable device to be expanded and modified.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
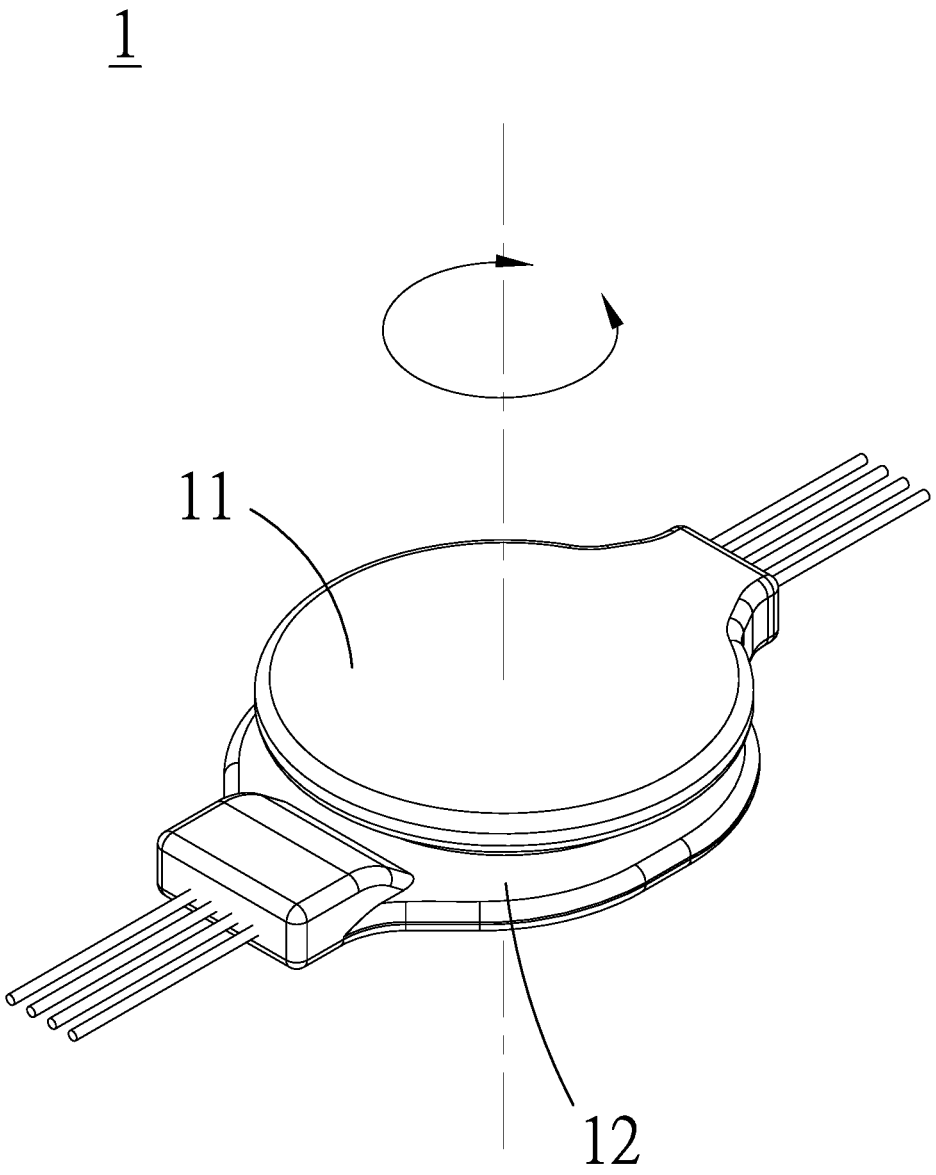
FIG. 1 is a schematic diagram of a connector assembly according to the present invention.
Figure 2:
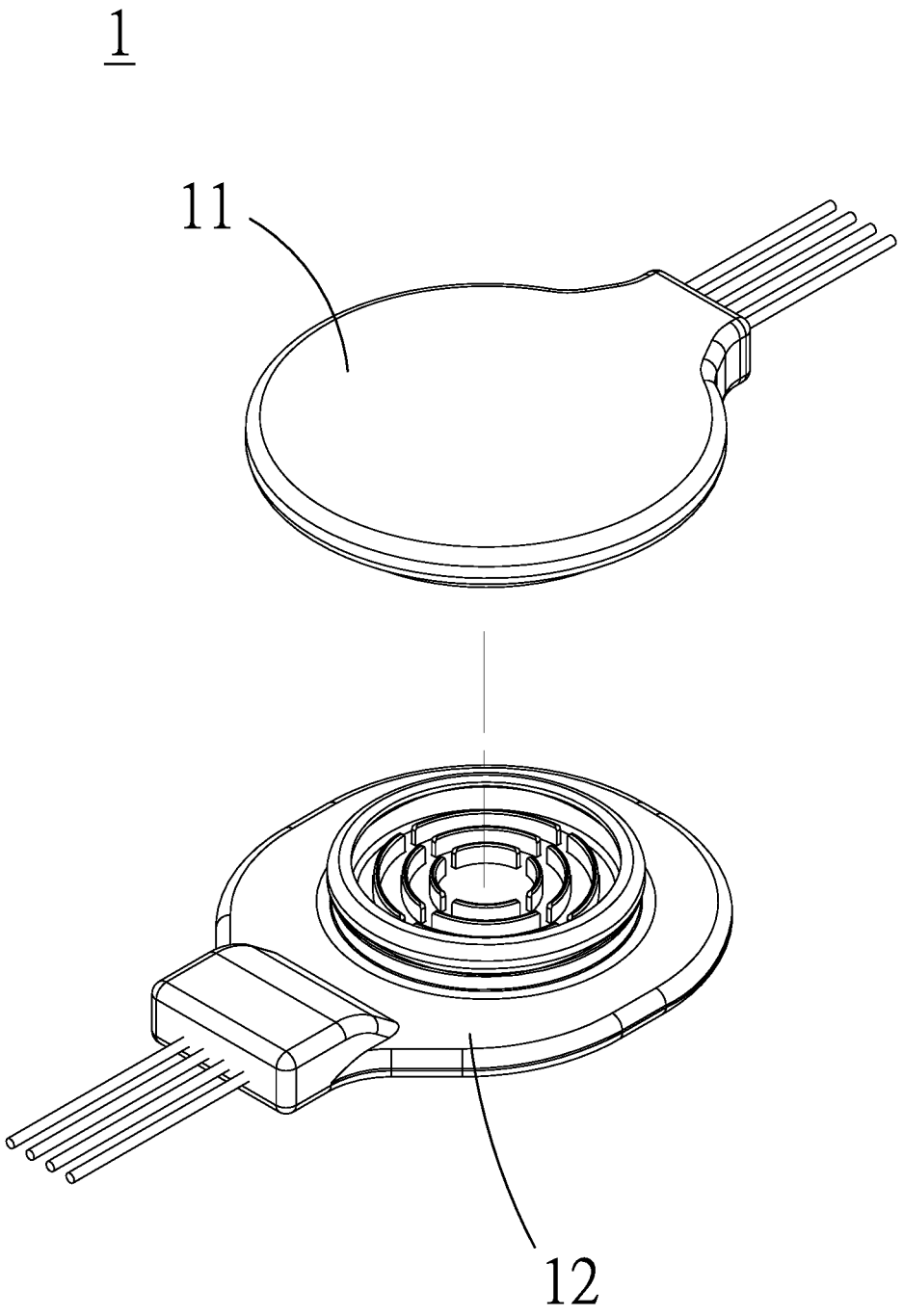
FIG. 2 is a partial parts breakdown schematic diagram of the connector assembly.
Figure 3:
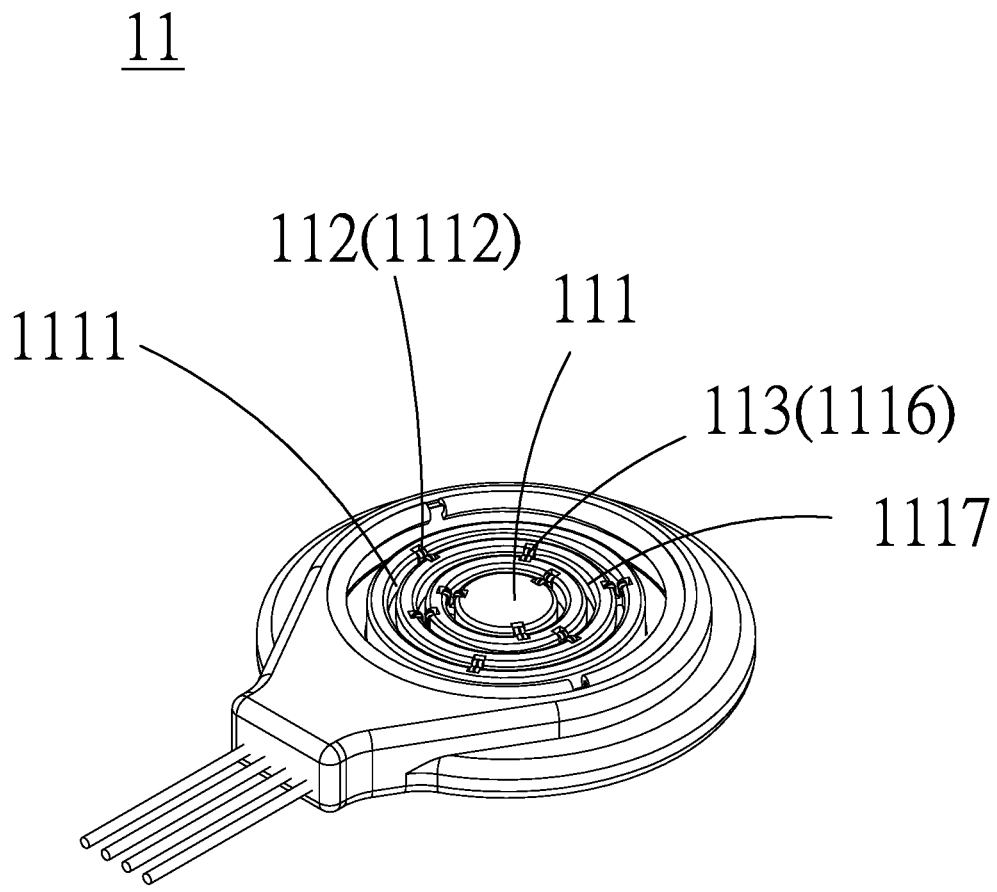
FIGS. 3 to 5 are partial structural schematic diagrams of a female connector.

Embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions of elements may be exaggerated for clarity, and the same reference numerals will be used throughout to designate the same or like components.

In order to make the disclosure more concise and easier to understand, the same or similarly functioning elements in the following embodiments will be described with the same symbols, and the description of the same or equivalent features will be omitted.

The present invention provides a connector assembly, which is described below according to its preferred embodiments with reference to FIGS. 1 to 6, 6*a*, 6*b* and 7-13.

As shown in FIG. 1, the connector assembly 1 according to the present invention includes a female connector 11 and a male connector 12 that structurally match.

As shown in FIGS. 3 to 6 and 6*a*, the female connector 11 includes: a female insulator 111, a plurality of first female conductors 112 (for example, three) and a plurality of second female conductors 113 (for example, three). The female insulator 111 is defined with a first female circular trajectory P11 and a second female circular trajectory P21, and includes a first female circular insertion slot 1111, a plurality of first female conductor mounting areas 1112, an outer female circular wall 1113, a middle female circular wall 1114, an inner female circular wall 1115, a plurality of second female conductor mounting areas 1116 and a second female circular insertion slot 1117. The first female circular trajectory P11 has a diameter larger than that of the second female circular trajectory P21, making the second female circular trajectory P21 surrounded by the first female circular trajectory P11.

Figure 6:
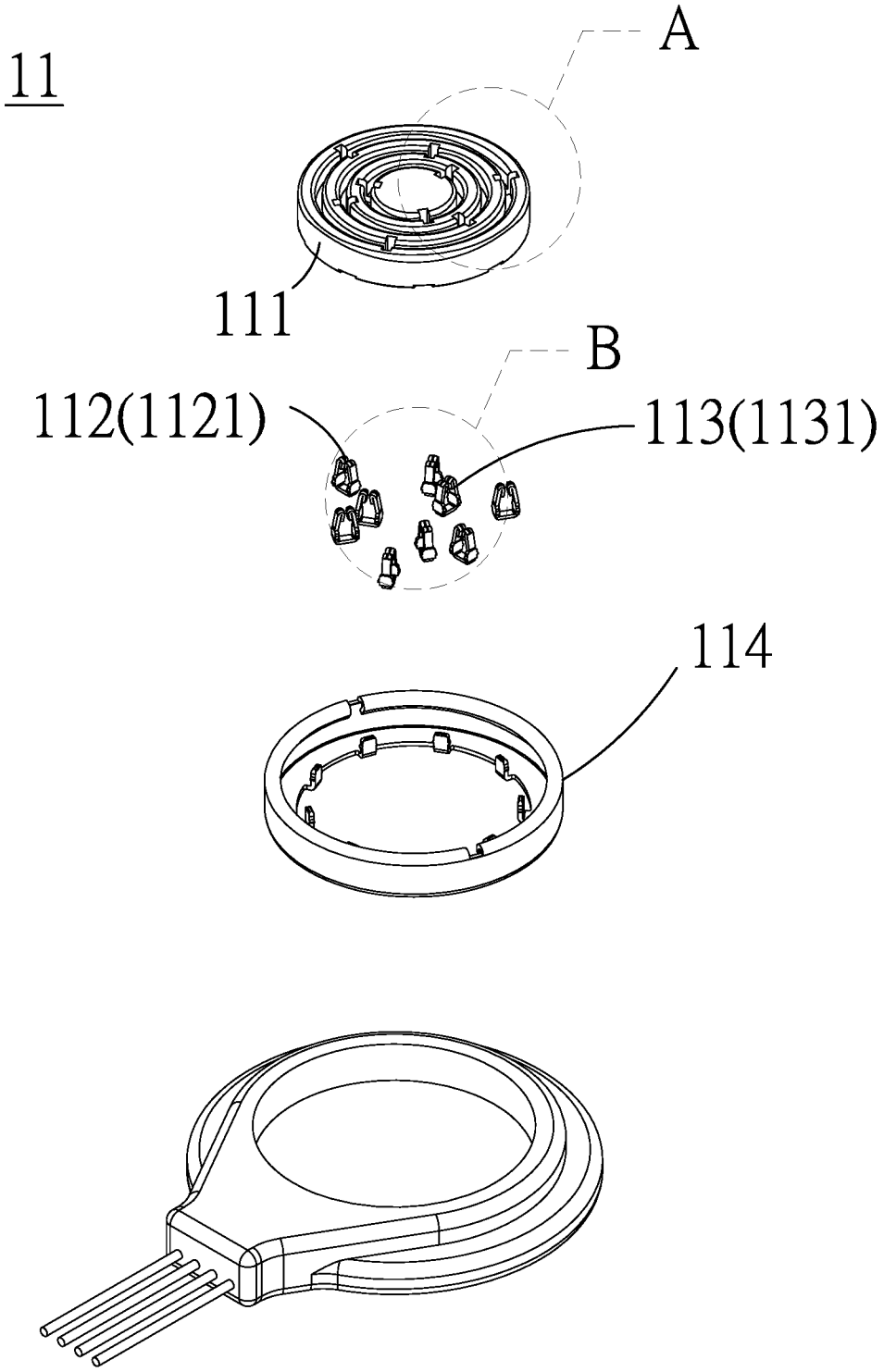
FIG. 6 is a partial parts breakdown schematic diagram of the female connector shown in FIG. 3.
Figure 6A:
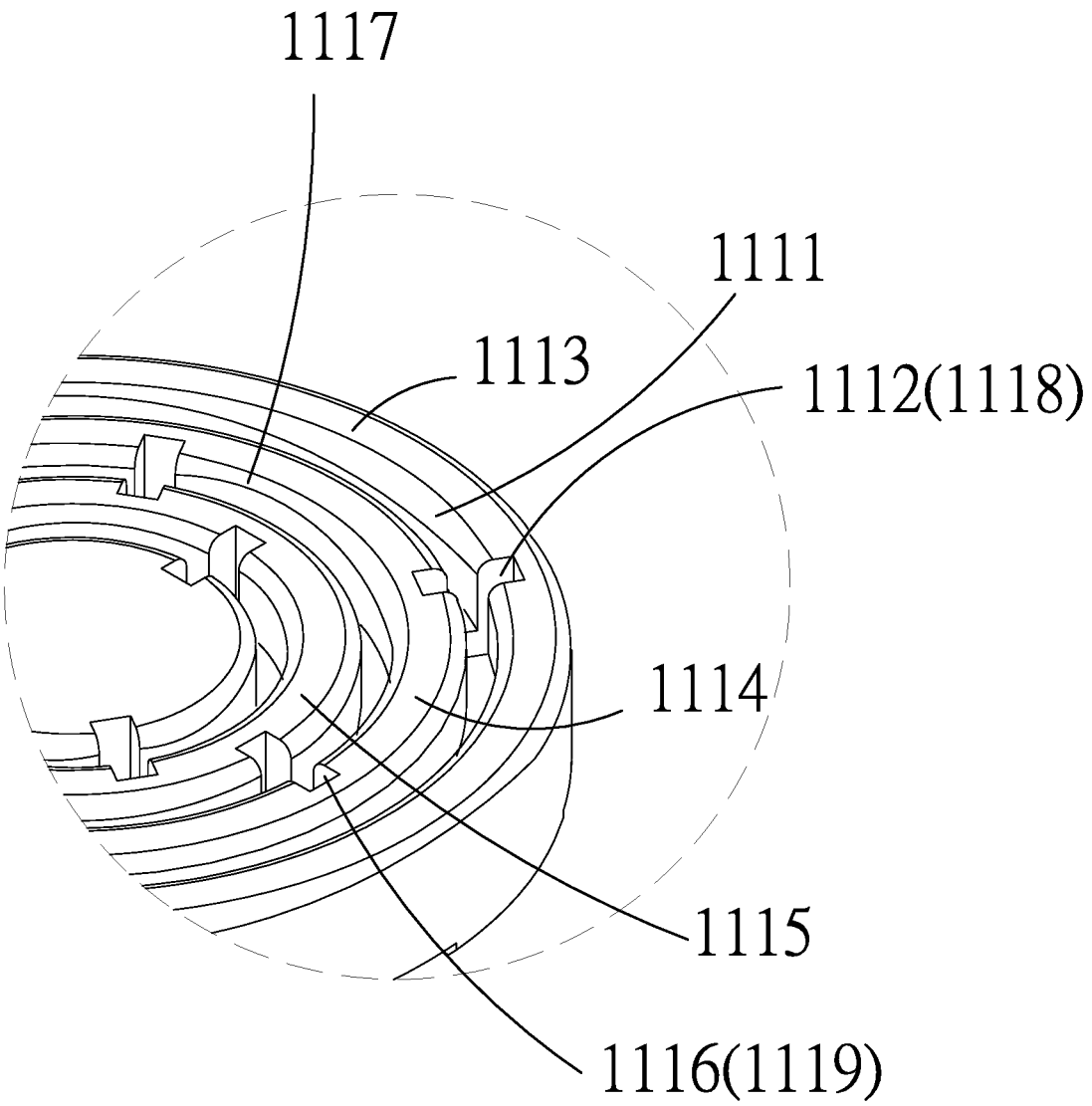
FIG. 6*a* is a local enlargement schematic diagram of area A in FIG. 6.
Figure 6B:
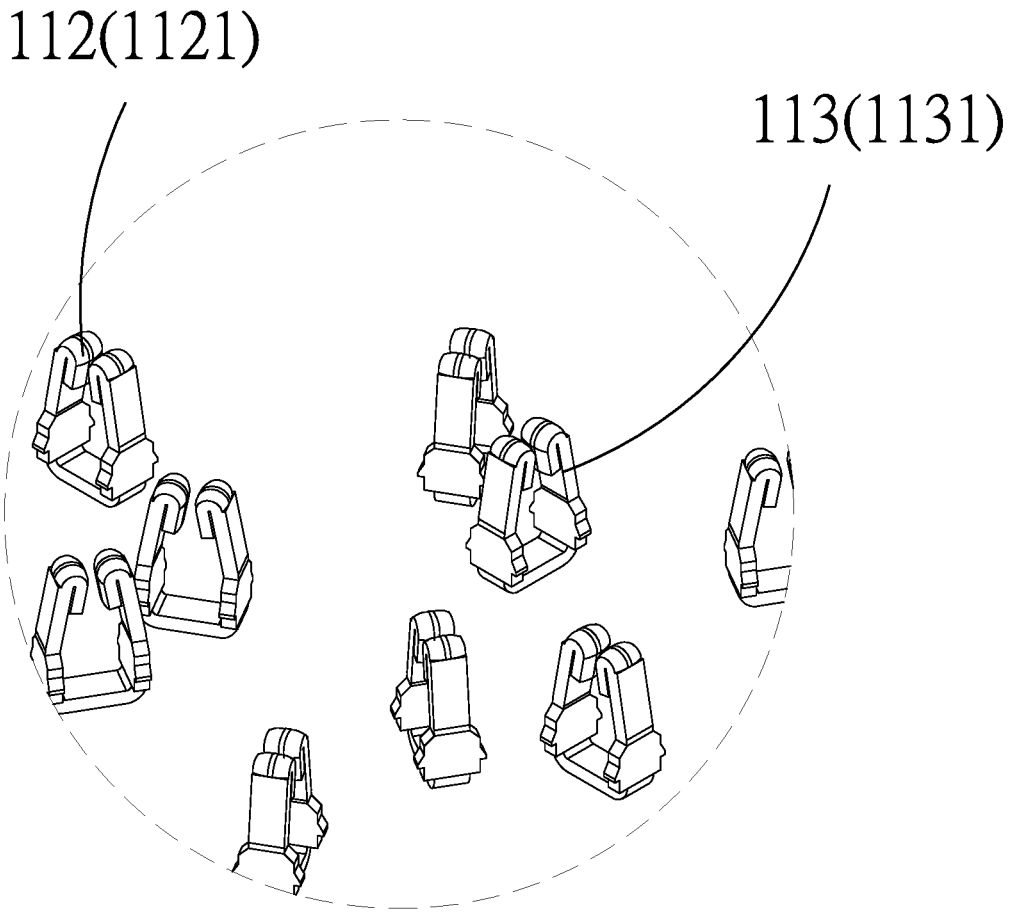
FIG. 6*b* is a local enlargement schematic diagram of area B in FIG. 6.
Figure 7:
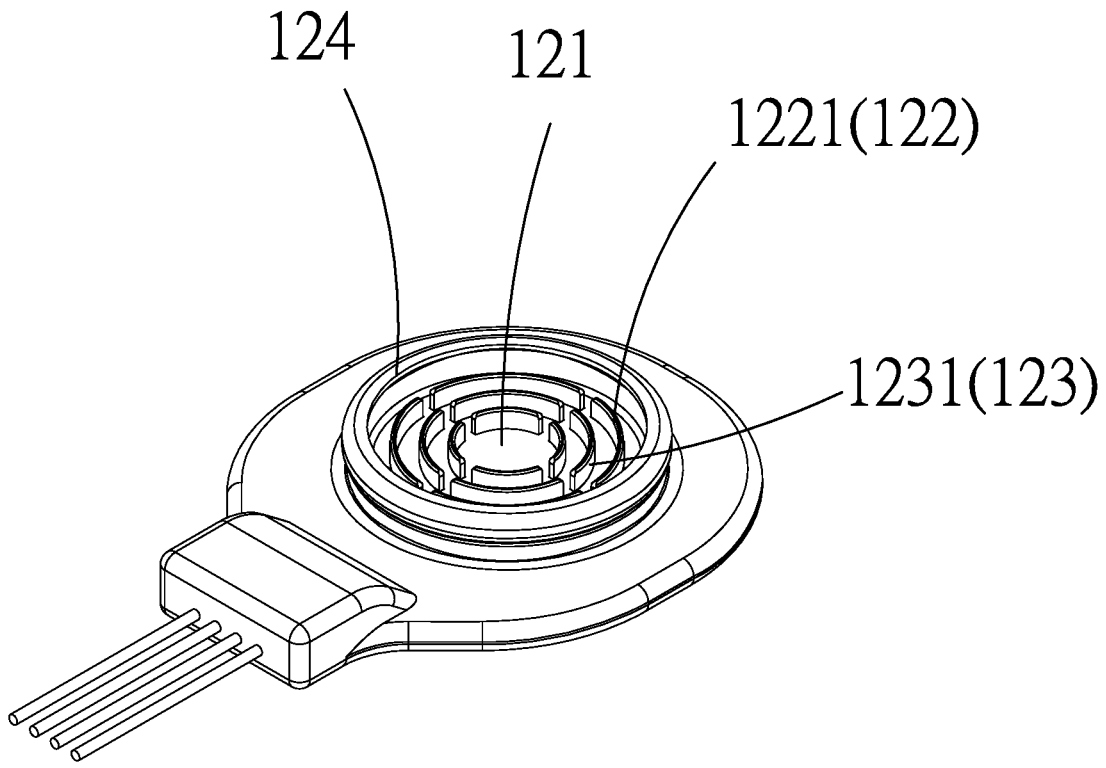
FIGS. 7 to 9 are partial structural schematic diagrams of a male connector.
Figure 8:
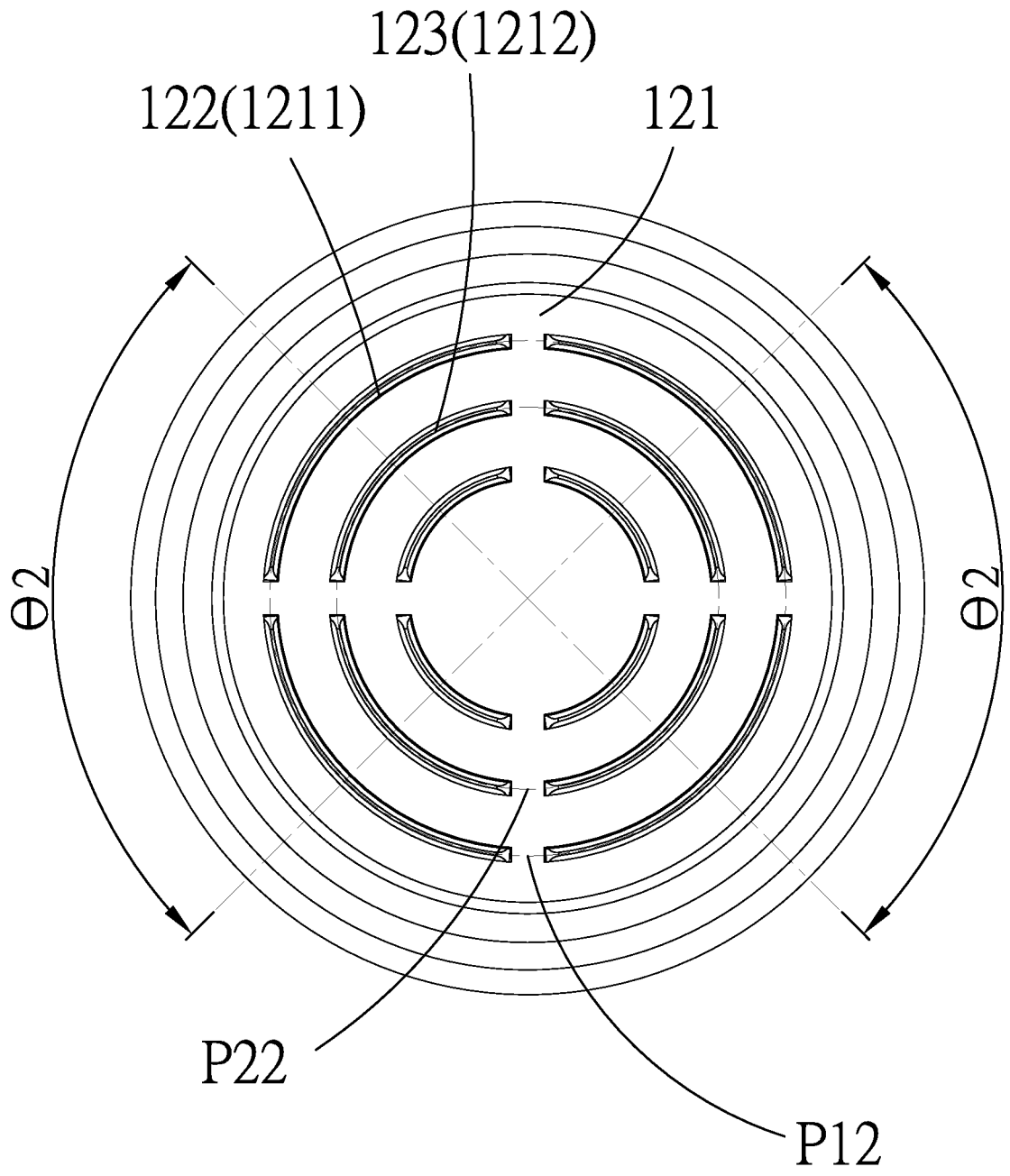
Figure 9:
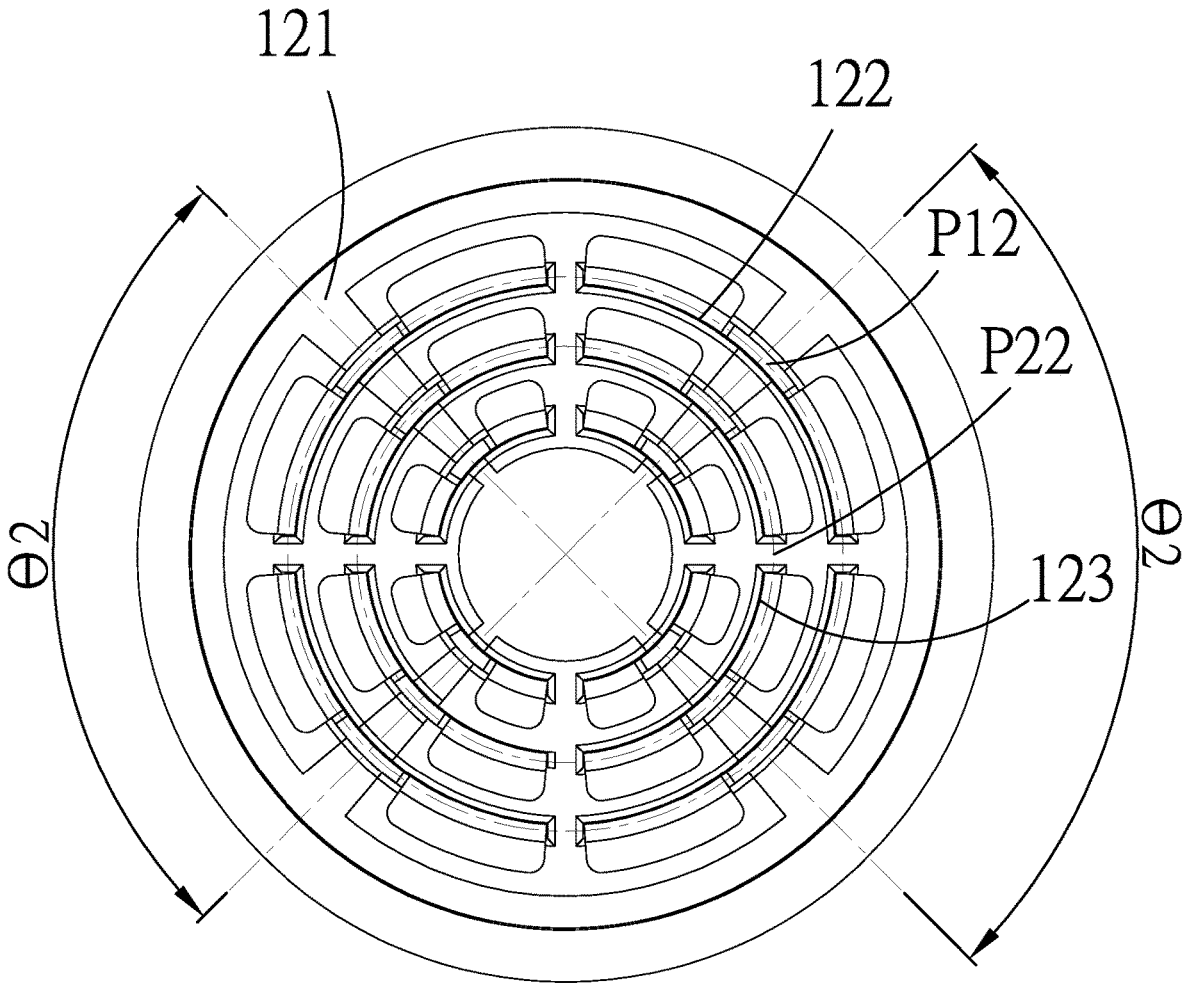
Figure 10:
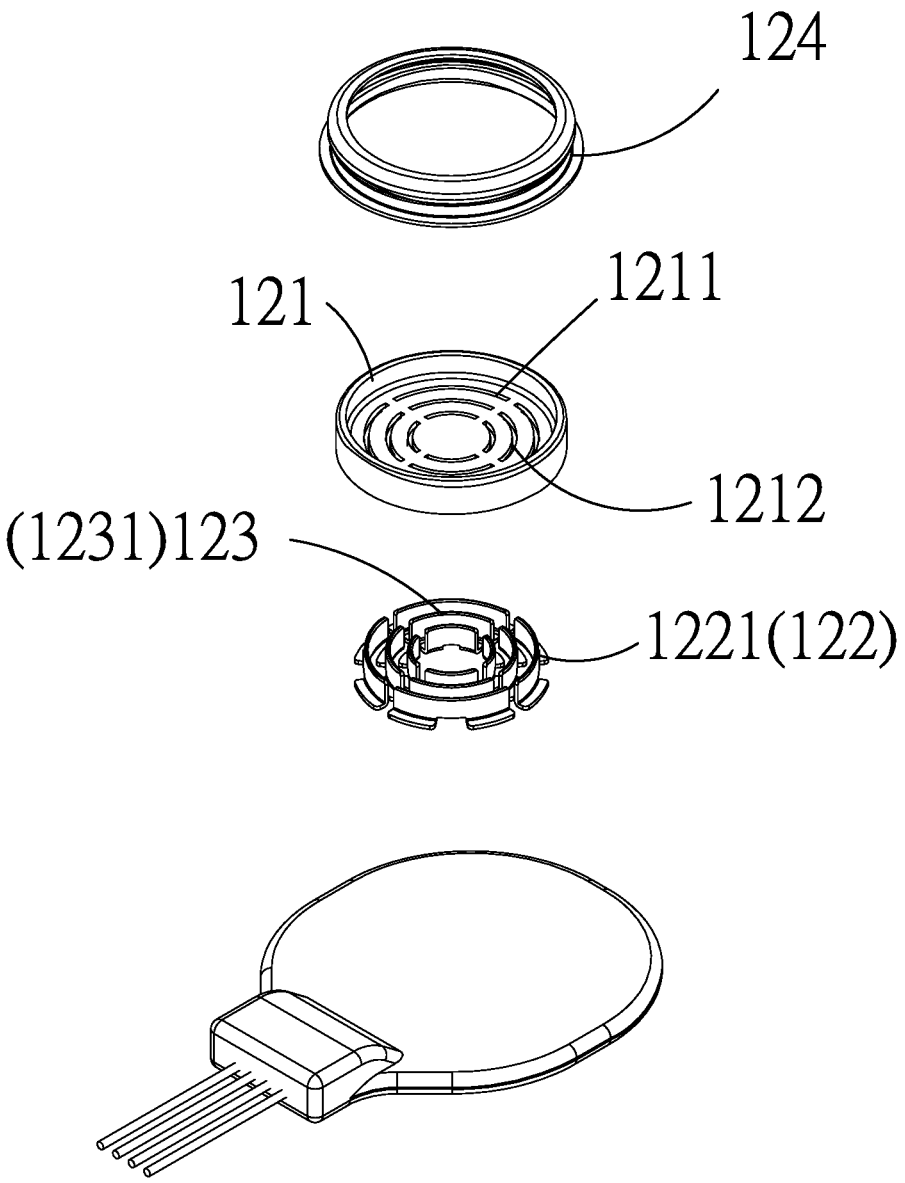
FIG. 10 is a partial parts breakdown schematic diagram of the male connector shown in FIG. 7.
Figure 11:
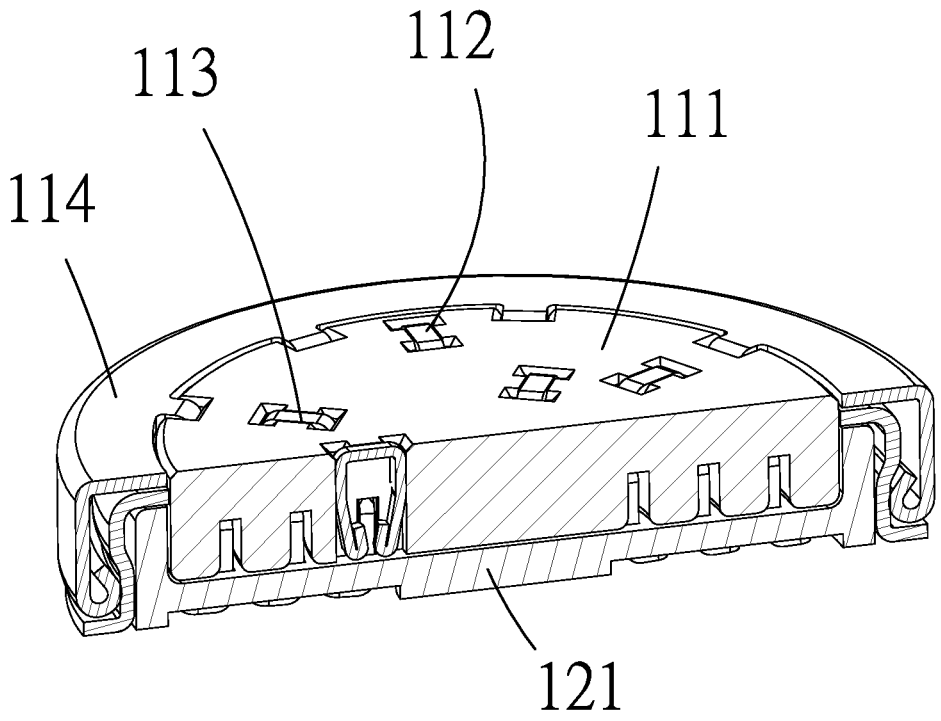
FIGS. 11 to 13 are schematic diagrams showing a status of electrical connection between the female connector and the male connector.
Figure 12:
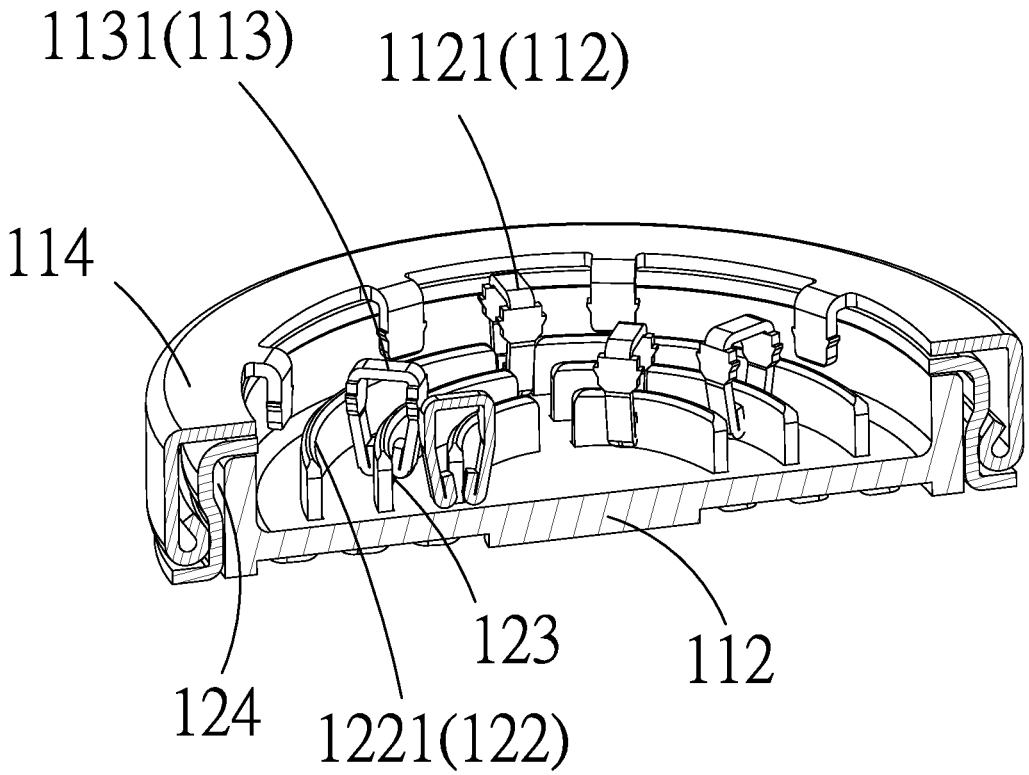

As shown in FIGS. 6 and 6*a*, the outer female circular wall 1113 has a diameter larger than that of the middle female circular wall 1114, and the middle female circular wall 1114 has a diameter larger than that of the inner female circular wall 1115, such that the middle female circular wall 1114 is surrounded by the outer female circular wall 1113, and the inner female circular wall 1115 is surrounded by the middle female circular wall 1114. The first female circular insertion slot 1111 and the plurality of first female conductor mounting areas 1112 are located between the outer female circular wall 1113 and the middle female circular wall 1114. The second female circular insertion slot 1117 and the plurality of second female conductor mounting areas 1116 are located between the middle female circular wall 1114 and the inner female circular wall 1115.

Figure 4:
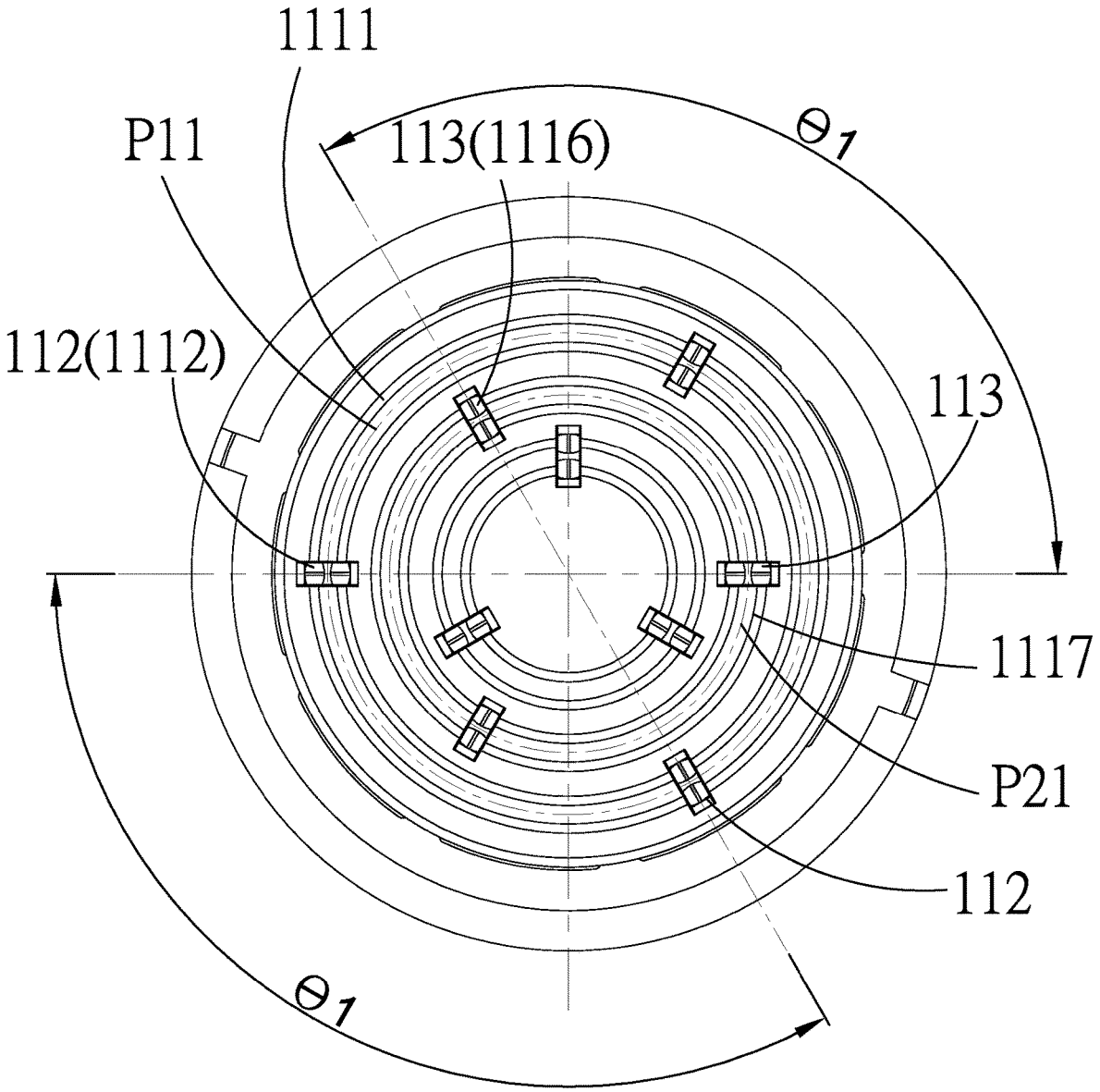
Figure 5:
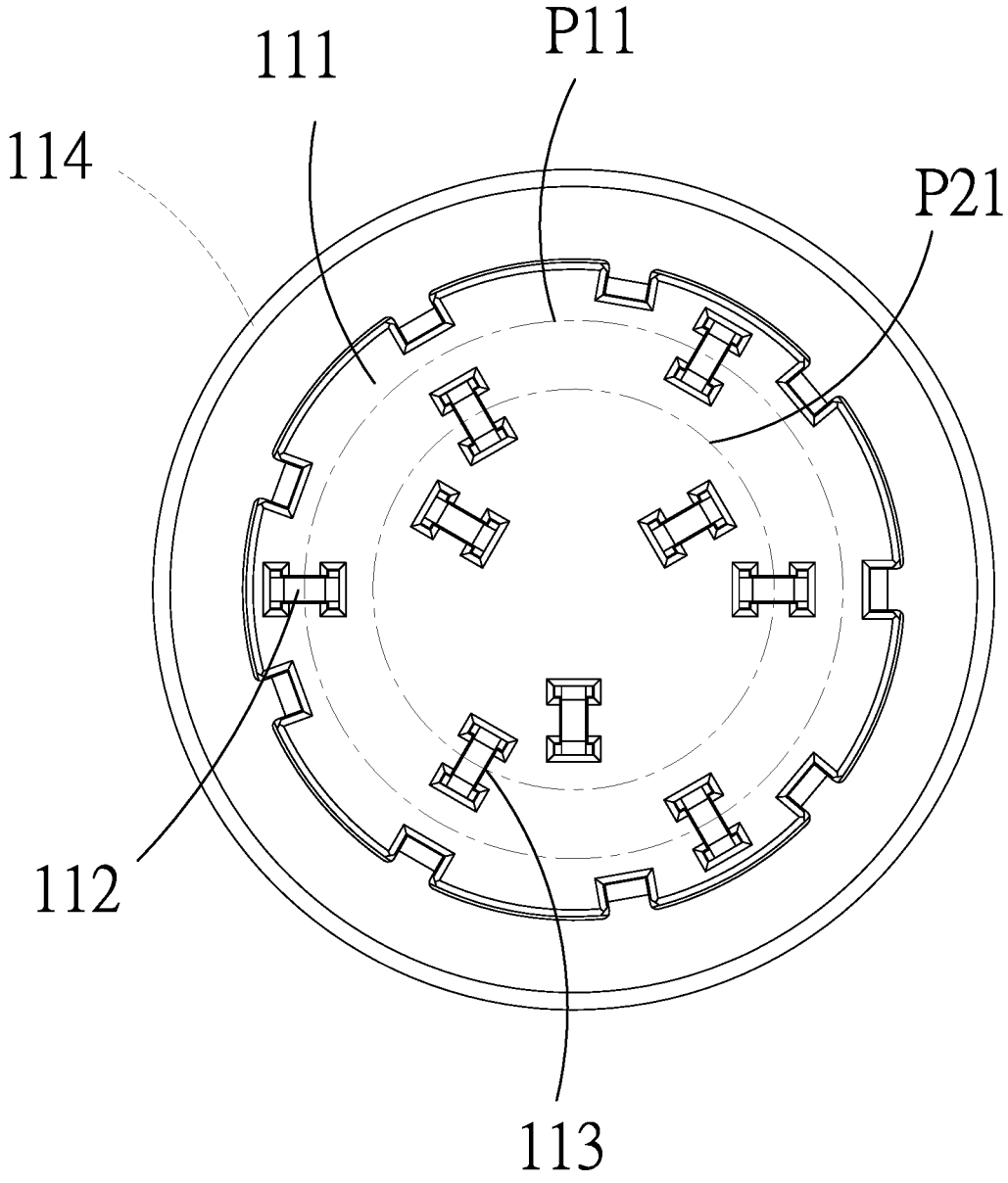

As shown in FIG. 4, the first female circular insertion slot 1111 is extended along the first female circular trajectory P11, and the plurality of first female conductor mounting areas 1112 are placed at intervals along the first female circular trajectory P11 in a manner that, on the first female circular trajectory P11 there is an interval of first arc angle θ1 between adjacent two of the first female conductor mounting areas 1112.

The number of the first female conductors 112 is substantially the same as that of the first female conductor mounting areas 1112, such that each of the first female conductors 112 is mounted on a corresponding one of the first female conductor mounting areas 1112, and adjacent two of the first female conductors 112 are spaced at the interval of first arc angle θ1 on the first female circular trajectory P11. It should be noted that, the number of the first female conductors 112 is however not limited to being equal to that of the first female conductor mounting areas 1112.

As shown in FIG. 6*a*, the female insulator 111 further includes a plurality of first conductor embedding slots 1118, wherein each of the first conductor embedding slots 1118 resides in a corresponding one of the first female conductor mounting areas 1112 and is extended to the outer female circular wall 1113 or the middle female circular wall 1114. This allows the outer female circular wall 1113 or the middle female circular wall 1114 to fix the plurality of first female conductors 112 in position respectively with help from the first conductor embedding slots 1118 when the first female conductors 112 are mounted on the first female conductor mounting areas 1112 and embedded in the first conductor embedding slots 1118, such that the first female conductors 112 are less likely to be deformed by external force.

As shown in FIG. 4, the second female circular insertion slot 1117 is extended along the second female circular trajectory P21, and the plurality of second female conductor mounting areas 1116 are placed at intervals along the second female circular trajectory P21 in a manner that, on the second female circular trajectory P21 the interval of first arc angle θ1 is provided between adjacent two of the second female conductor mounting areas 1116.

The number of the second female conductors 113 is substantially the same as that of the second female conductor mounting areas 1116, such that each of the second female conductors 113 is mounted on a corresponding one of the second female conductor mounting areas 1116, and adjacent two of the second female conductors 113 are spaced at the interval of first arc angle θ1 on the second female circular trajectory P21. It should be noted that, the number of the second female conductors 113 is however not limited to being equal to that of the second female conductor mounting areas 1116.

As shown in FIG. 6*a*, the female insulator 111 further includes a plurality of second conductor embedding slots 1119, wherein each of the second conductor embedding slots 1119 resides in a corresponding one of the second female conductor mounting areas 1116 and is extended to the middle female circular wall 1114 or the inner female circular wall 1115. This allows the middle female circular wall 1114 or the inner female circular wall 1115 to fix the plurality of second female conductors 113 in position respectively with help from the second conductor embedding slots 1119 when the second female conductors 113 are mounted on the second female conductor mounting areas 1116 and embedded in the second conductor embedding slots 1119, such that the second female conductors 113 are less likely to be deformed by external force.

As shown in FIGS. 7 to 10, the male connector 12 includes: a male insulator 121, a plurality of first male conductors 122 (for example, four) and a plurality of second male conductors 123 (for example, four). The male insulator 121 is defined with a first male circular trajectory P12 and a second male circular trajectory P22, and includes a plurality of first male conductor mounting areas 1211 and a plurality of second male conductor mounting areas 1212. The plurality of first male conductor mounting areas 1211 are placed at intervals along the first male circular trajectory P12 in a manner that, on the first male circular trajectory P12 there is an interval of second arc angle θ2 between adjacent two of the first male conductor mounting areas 1211. The plurality of second male conductor mounting areas 1212 are placed at intervals along the second male circular trajectory P22 in a manner that, on the second male circular trajectory P22 there is an interval of second arc angle θ2 between adjacent two of the second male conductor mounting areas 1212.

The number of the first male conductors 122 is substantially the same as that of the first male conductor mounting areas 1211, such that each of the first male conductors 122 is mounted on a corresponding one of the first male conductor mounting areas 1211, and adjacent two of the first male conductors 122 are spaced at the interval of second arc angle θ2 on the first male circular trajectory P12. It should be noted that, the number of the first male conductors 122 is however not limited to being equal to that of the first male conductor mounting areas 1211.

The number of the second male conductors 123 is substantially the same as that of the second male conductor mounting areas 1212, such that each of the second male conductors 123 is mounted on a corresponding one of the second male conductor mounting areas 1212, and adjacent two of the second male conductors 123 are spaced at the interval of second arc angle θ2 on the second male circular trajectory P22. It should be noted that, the number of the second male conductors 123 is however not limited to being equal to that of the second male conductor mounting areas 1212.

Figure 13:
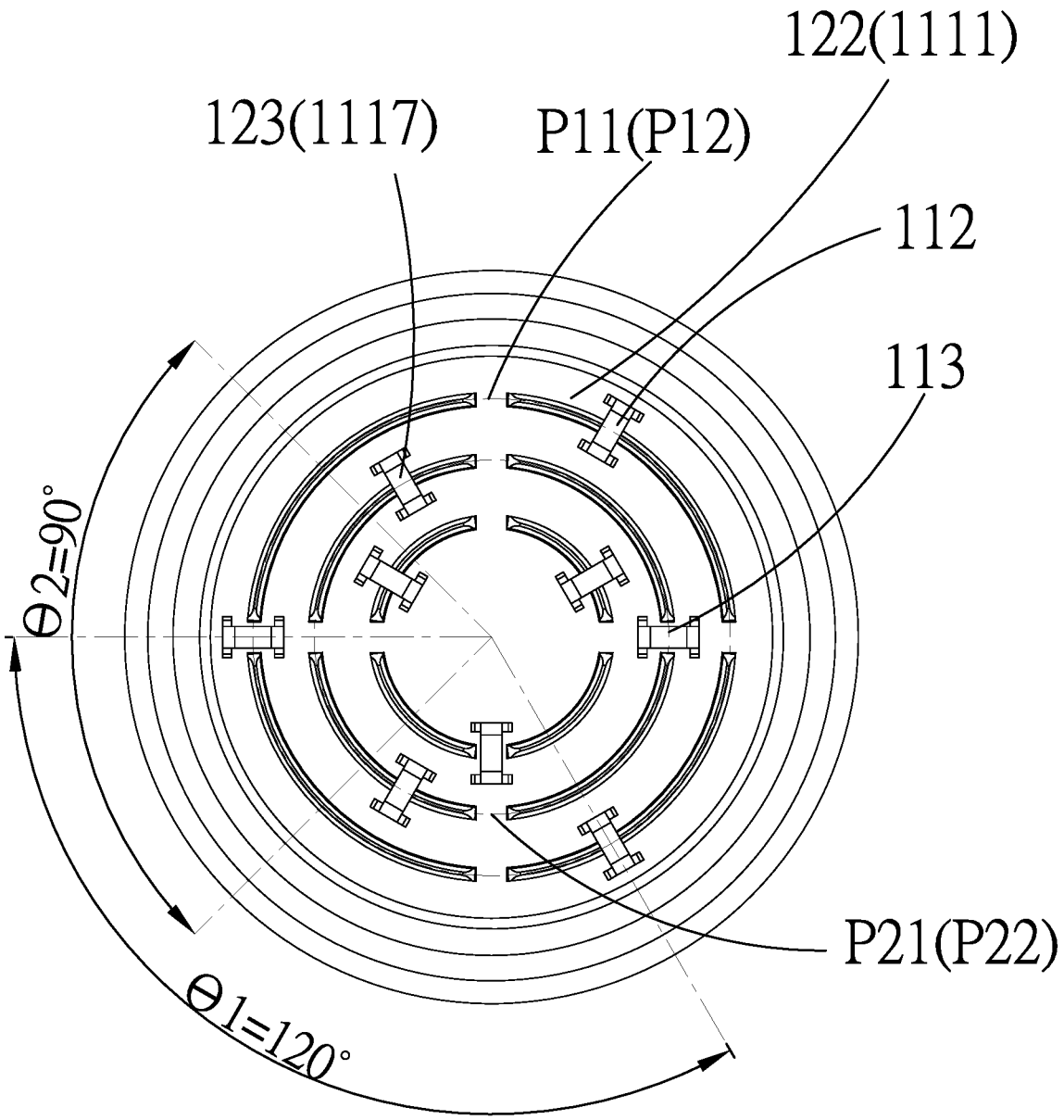

As shown in FIG. 13, the first female circular trajectory P11 and the first male circular trajectory P12 have substantially the same contour. Thus, the first male conductors 122 placed along the first male circular trajectory P12 can enter the first female circular insertion slot 1111 formed along the first female circular trajectory P11, and can individually rotate within the first female circular insertion slot 1111, such that the female connector 11 and the male connector 12, which are electrically interconnected, can rotate relative to each other. When this configuration applies to a wearable device, relative rotation of both the electrically interconnected female and male connectors 11, 12 is allowed in response to structural arrangement of the wearable device, thereby making function elements of the wearable device able to be expanded and modified.

The second female circular trajectory P21 and the second male circular trajectory P22 have substantially the same contour. Thus, the second male conductors 123 placed along the second male circular trajectory P22 can enter the second female circular insertion slot 1117 formed along the second female circular trajectory P21, and can individually rotate within the second female circular insertion slot 1117, such that the female connector 11 and the male connector 12, which are electrically interconnected, can rotate relative to each other. When this configuration applies to the wearable device, relative rotation of both the electrically interconnected female and male connectors 11, 12 is allowed in response to structural arrangement of the wearable device, thereby making the function elements of the wearable device able to be expanded and modified.

To ensure the electrical connection between the female connector 11 and the male connector 12, the first arc angle θ1 is substantially different in value from the second arc angle θ2; in other words, the plurality of first female conductors 112 are substantially different in number from the plurality of first male conductors 122, and the plurality of second female conductors 113 are substantially different in number from the plurality of second male conductors 123. Thus, at least one of the plurality of first female conductors 112 can be electrically connected to at least one of the plurality of first male conductors 122 entering the first female circular insertion slot 1111, and at least one of the plurality of second female conductors 113 can be electrically connected to at least one of the plurality of second male conductors 123 entering the second female circular insertion slot 1117, such that the electrical connection between the female connector 11 and the male connector 12 is achieved.

For example, as shown in FIG. 13, the female connector 11 includes three first female conductors 112 and three second female conductors 113, and the first arc angle θ1 is substantially an angle of 120 degrees, while the male connector 12 includes four first male conductors 122 and four second male conductors 123, and the second arc angle θ2 is substantially an angle of 90 degrees, that is, the first arc angle θ1 is substantially different in value from the second arc angle θ2. With this configuration, two of the three first female conductors 112 can both be electrically connected to two of the four first male conductors 122 regardless of relative positions of the three first female conductors 112 and the four first male conductors 122, and two of the three second female conductors 113 can both be electrically connected to two of the four second male conductors 123 regardless of relative positions of the three second female conductors 113 and the four second male conductors 123, thereby assuring the electrical connection between the female connector 11 and the male connector 12.

Each of the plurality of first female conductors 112 includes a first clamping structure 1121, and correspondingly each of the plurality of first male conductors 122 includes a first flake-shaped structure 1221. With the first clamping structure 1121 structurally gripping the first flake-shaped structure 1221, at least one of the plurality of first female conductors 112 can hold in position at least one of the plurality of first male conductors 122 entering the first female circular insertion slot 1111. The first clamping structure 1121 can also rotate relative to the first flake-shaped structure 1221. When this configuration is applied to the wearable device, the electrically interconnected female and male connectors 11, 12 are both allowed to have relative rotation in response to structural arrangement of the wearable device, thereby in favor of expansion and modification of the function elements of the wearable device.

Each of the plurality of second female conductors 113 includes a second clamping structure 1131, and correspondingly each of the plurality of second male conductors 123 includes a second flake-shaped structure 1231. With the second clamping structure 1131 structurally gripping the second flake-shaped structure 1231, at least one of the plurality of second female conductors 113 can hold in position at least one of the plurality of second male conductors 123 entering the second female circular insertion slot 1117. The second clamping structure 1131 can also rotate relative to the second flake-shaped structure 1231. When this configuration is applied to the wearable device, the electrically interconnected female and male connectors 11, 12 are both allowed to have relative rotation in response to structural arrangement of the wearable device, thereby in favor of expansion and modification of the function elements of the wearable device.

In order to prevent both the electrically interconnected female and male connectors 11, 12 from being separated by external force, the male connector 12 further includes a male fastening structure 124 such as a wall-shaped structure for coupling the male insulator 121. The male fastening structure 124 is provided along the first male circular trajectory P12 to form a circular contour surrounding the male insulator 121 and the plurality of first male conductors 122. Correspondingly, the female connector 11 further includes a female fastening structure 114 such as a wall-shaped structure for coupling the female insulator 111. The female fastening structure 114 is provided along the first female circular trajectory P11 to form a circular contour surrounding the female insulator 111 and the plurality of first female conductors 112. During the process of the first male conductors 122 entering the first female circular insertion slot 1111, the male fastening structure 124 is fastened to the female fastening structure 114 to maintain the electrical connection between the female connector 11 and the male connector 12. When this configuration is applied to the wearable device, the male fastening structure 124 and the female fastening structure 114 both have the circular contour and thus can rotate relative to each other, such that relative rotation of both the electrically interconnected female and male connectors 11, 12 is allowed in response to structural arrangement of the wearable device, thereby making the function elements of the wearable device able to be expanded and modified.

In summary, a primary object of the present invention is to provide a connector assembly including a female connector and a male connector. The female connector and the male connector both can rotate relatively. The female connector includes a plurality of female conductors, and the male connector includes a plurality of male conductors. When the female connector and the male connector both rotate relatively, each of the female conductors can be electrically connected to at least one of the plurality of male conductors, thereby assuring electrical connection between the female connector and the male connector. This configuration, when being applied to a wearable device, allows function elements of the wearable device to be expanded and modified.

The examples above are only illustrative to explain principles and effects of the invention, but not to limit the invention. It will be apparent to those skilled in the art that modifications and variations can be made without departing from the scope of the invention. Therefore, the protection range of the rights of the invention should be as defined by the appended claims.

What is claimed is:

1. A connector assembly including:

a female connector including:

a female insulator defined with a first female circular trajectory, and including a first female circular insertion slot and a plurality of first female conductor mounting areas, wherein the first female circular insertion slot is extended along the first female circular trajectory, and the plurality of first female conductor mounting areas are placed at intervals along the first female circular trajectory in a manner that, on the first female circular trajectory there is an interval of first arc angle between adjacent two of the first female conductor mounting areas;

a plurality of first female conductors, each of which is mounted on a corresponding one of the plurality of first female conductor mounting areas, wherein the plurality of first female conductors are provided on the first female circular trajectory with the interval of first arc angle between adjacent two of the first female conductors; and a male connector including:

a male insulator defined with a first male circular trajectory and including a plurality of first male conductor mounting areas, wherein the plurality of first male conductor mounting areas are placed at intervals along the first male circular trajectory in a manner that, on the first male circular trajectory there is an interval of second arc angle between adjacent two of the first male conductor mounting areas;

a plurality of first male conductors, each of which is mounted on a corresponding one of the plurality of first male conductor mounting areas, wherein the plurality of first male conductors are provided on the first male circular trajectory with the interval of second arc angle between adjacent two of the first male conductors; wherein, the first female circular trajectory and the first male circular trajectory have substantially identical contour, allowing each of the first male conductors to be able to enter the first female circular insertion slot;

the first arc angle is substantially different in value from the second arc angle, allowing at least one of the plurality of first female conductors to be electrically connected to at least one of the plurality of first male conductors entering the first female circular insertion slot so as to assure electrical connection between the female connector and the male connector.

2. The connector assembly according to claim 1, wherein the plurality of first female conductors are substantially different in number from the plurality of first male conductors.

3. The connector assembly according to claim 1, wherein each of the plurality of first female conductors includes a first clamping structure, and each of the plurality of first male conductors includes a first flake-shaped structure, allowing at least one of the plurality of first female conductors to grip and hold in position at least one of the plurality of first male conductors entering the first female circular insertion slot; each of the plurality of second female conductors includes a second clamping structure, and each of the plurality of second male conductors includes a second flake-shaped structure, allowing at least one of the plurality of second female conductors to grip and hold in position at least one of the plurality of second male conductors entering the second female circular insertion slot.

4. The connector assembly according to claim 1, wherein the male connector further includes a male fastening structure for coupling the male insulator and provided along the first male circular trajectory, and the female connector further includes a female fastening structure for coupling the female insulator and provided along the first female circular trajectory, wherein when the first male conductors are entering the first female circular insertion slot, the male fastening structure is fastened to the female fastening structure.

5. The connector assembly according to claim 1, wherein the first arc angle is substantially an angle of 120 degrees, and the second arc angle is substantially an angle of 90 degrees.

6. The connector assembly according to claim 1, wherein the female insulator further includes: an outer female circular wall and a middle female circular wall, wherein the middle female circular wall is surrounded by the outer female circular wall, wherein the first female circular insertion slot and the plurality of first female conductor mounting areas are located between the outer female circular wall and the middle female circular wall.

7. The connector assembly according to claim 6, wherein the female insulator further includes a plurality of first conductor embedding slots, each of which resides in a corresponding one of the plurality of first female conductor mounting areas and is extended to the outer female circular or the middle female circular wall, allowing the outer female circular wall or the middle female circular wall to fix the plurality of first female conductors in position.

8. The connector assembly according to claim 1, wherein, the female connector further includes a plurality of second female conductors;

the female insulator is further defined with a second female circular trajectory, and includes a second female circular insertion slot and a plurality of second female conductor mounting areas, wherein the second female circular insertion slot is extended along the second female circular trajectory, and the plurality of second female conductor mounting areas are placed along the second female circular trajectory in a manner that, on the second female circular trajectory the interval of first arc angle is provided between adjacent two of the second female conductor mounting areas;

each of the plurality of second female conductors is mounted on a corresponding one of the plurality of second female conductor mounting areas, wherein the plurality of second female conductors are provided on the second female circular trajectory with the interval of first arc angle between adjacent two of the second female conductors;

the male connector further includes a plurality of second male conductors;

the male insulator is further defined with a second male circular trajectory and includes a plurality of second male conductor mounting areas, wherein the plurality of second male conductor mounting areas are placed along the second male circular trajectory in a manner that, on the second male circular trajectory the interval of second arc angle is provided between adjacent two of the second male conductor mounting areas;

each of the plurality of second male conductors is mounted on a corresponding one of the plurality of second male conductor mounting areas, wherein the plurality of second male conductors are provided on the second male circular trajectory with the interval of second arc angle between adjacent two of the second male conductors; wherein, the second female circular trajectory and the second male circular trajectory have substantially identical contour, allowing each of the second male conductors to be able to enter the second female circular insertion slot;

the first arc angle is substantially different in value from the second arc angle, allowing at least one of the plurality of second female conductors to be electrically connected to at least one of the plurality of second male conductors entering the second female circular insertion slot so as to achieve the electrical connection between the female connector and the male connector.

9. The connector assembly according to claim 8, wherein the plurality of second female conductors are substantially different in number from the plurality of second male conductors.

10. The connector assembly according to claim 8, wherein the second female circular trajectory is surrounded by the first female circular trajectory.

11. The connector assembly according to claim 8; wherein the female insulator further includes: an outer female circular wall, a middle female circular wall and an inner female circular wall, wherein the middle female circular wall is surrounded by the outer female circular wall, and the inner female circular wall is surrounded by the middle female circular wall, wherein the first female circular insertion slot and the plurality of first female conductor mounting areas are located between the outer female circular wall and the middle female circular wall, and the second female circular insertion slot and the plurality of second female conductor mounting areas are located between the middle female circular wall and the inner female circular wall.

12. The connector assembly according to claim 11, wherein the female insulator further includes a plurality of first conductor embedding slots, each of which resides in a corresponding one of the plurality of first female conductor mounting areas and is extended to the outer female circular wall or the middle female circular wall, allowing the outer female circular wall or the middle female circular wall to fix the plurality of first female conductors in position; the female insulator further includes a plurality of second conductor embedding slots, each of which resides in a corresponding one of the plurality of second female conductor mounting areas and is extended to the middle female circular wall or the inner female circular wall, allowing the middle female circular wall or the inner female circular wall to fix the plurality of second female conductors in position.

* * * * *